US009754757B2

(12) United States Patent
Nishida et al.

(10) Patent No.: US 9,754,757 B2
(45) Date of Patent: Sep. 5, 2017

(54) ION GENERATION APPARATUS AND ELECTRIC EQUIPMENT INCLUDING THE SAME

(71) Applicant: Sharp Kabushiki Kaisha, Osaka-shi, Osaka (JP)

(72) Inventors: Hiromu Nishida, Osaka (JP); Koichi Izu, Osaka (JP); Nobuyuki Ohe, Osaka (JP); Yoshinori Sekoguchi, Osaka (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 14/889,263

(22) PCT Filed: Feb. 27, 2014

(86) PCT No.: PCT/JP2014/054797

§ 371 (c)(1),
(2) Date: Nov. 5, 2015

(87) PCT Pub. No.: WO2014/203562

PCT Pub. Date: Dec. 24, 2014

(65) Prior Publication Data

US 2016/0104595 A1 Apr. 14, 2016

(30) Foreign Application Priority Data

Jun. 20, 2013 (JP) ..... 2013-129348

(51) Int. Cl.
*H01J 27/02* (2006.01)
*H01T 19/04* (2006.01)
(Continued)

(52) U.S. Cl.
CPC ..... *H01J 27/022* (2013.01); *H01J 27/26* (2013.01); *H01T 19/04* (2013.01); *H01T 23/00* (2013.01)

(58) Field of Classification Search
CPC ..... H01J 27/022; H01J 27/26; H01J 19/00; H01J 19/04; H01J 23/00
See application file for complete search history.

(56) References Cited

U.S. PATENT DOCUMENTS

2014/0103793 A1 4/2014 Nishida et al.

FOREIGN PATENT DOCUMENTS

JP 9-232068 A 9/1997
JP 2006-284164 A 10/2006
(Continued)

OTHER PUBLICATIONS

Machine translation of JP2009-238602A.*
Official Communication issued in International Patent Application No. PCT/JP2014/054797, mailed on May 20, 2014.

*Primary Examiner* — Anne Hines
(74) *Attorney, Agent, or Firm* — Keating & Bennett, LLP

(57) ABSTRACT

A housing, a substrate accommodated in the housing, a needle electrode for generating ions through discharging, which is held by the substrate such that a tip end portion protrudes outside the housing, an insulating sealing portion insulating and sealing the substrate in the housing, and an electrode protection portion for protecting the needle electrode outside the housing are included. The housing is provided with an opening portion through which a side of the tip end portion of the needle electrode is inserted and which is sealed with the insulating sealing portion. The electrode protection portion has a first protection portion and a second protection portion which are provided to protrude from the housing relative to the tip end portion of the needle electrode and opposed to each other at a distance from each other on opposing sides of the needle electrode.

8 Claims, 8 Drawing Sheets

(51) Int. Cl.
*H01T 23/00* (2006.01)
*H01J 27/26* (2006.01)

(56) References Cited

FOREIGN PATENT DOCUMENTS

| | | | |
|---|---|---|---|
| JP | 2009-238602 | A | 10/2009 |
| JP | 2013-41681 | A | 2/2013 |
| JP | 2013-65537 | A | 4/2013 |

* cited by examiner

ION GENERATION APPARATUS AND ELECTRIC EQUIPMENT INCLUDING THE SAME

TECHNICAL FIELD

This invention relates to an ion generation apparatus and electric equipment including the same, and particularly to an ion generation apparatus generating ions from a needle electrode through discharging and electric equipment including the same.

BACKGROUND ART

An ion generation apparatus has conventionally generated ions from a needle-shaped discharging electrode through discharging. An air conditioner described in Japanese Patent Laying-Open No. 2006-284164 (PTD 1) has a plurality of needle-shaped negative ion generation electrodes provided perpendicularly to a direction in which air is sent by a fan, such that tip ends thereof protrude in parallel to one another toward a clearance central portion of an outlet. The plurality of needle electrodes are arranged in parallel to one another in the direction of a clearance of the outlet, and a needle electrode to which a high voltage is applied and a grounded needle electrode are different in height from each other.

In addition, the plurality of needle electrodes are arranged upward toward the outlet and covered with a grid-like cage protecting the needle electrodes. In thus covering the needle electrodes with the grid-like cage, the grid-like cage is made as thin as possible in order not to increase a resistance in air passage, with an interval between grids small enough to avoid introduction of a finger being maintained.

CITATION LIST

Patent Document

PTD 1: Japanese Patent Laying-Open No. 2006-284164

SUMMARY OF INVENTION

Technical Problem

With continued use of the needle electrodes, however, charged dust is deposited thereon, which may adversely affect discharging. Therefore, the needle electrode should be cleaned with a cleaning brush or the like, depending on an environment of use. Here, when the needle electrodes for generating ions are covered with the thin grid-like cage as in the air conditioner described in PTD 1, it is difficult to insert the cleaning brush into the grid-like cage and hence difficult to efficiently perform a cleaning operation.

Therefore, a primary object of this invention is to provide an ion generation apparatus capable of allowing easy cleaning of a needle electrode while a finger is less likely to touch the needle electrode.

Solution to Problem

An ion generation apparatus according to this invention includes a housing, a substrate accommodated in the housing, a needle electrode for generating ions through discharging, which is held by the substrate such that a tip end portion protrudes outside the housing, an insulating sealing portion insulating and sealing the substrate in the housing, and an electrode protection portion for protecting the needle electrode outside the housing. The housing is provided with an opening portion through which a side of the tip end portion of the needle electrode is inserted and which is sealed with the insulating sealing portion, and the electrode protection portion has a first protection portion and a second protection portion provided to protrude from the housing relative to the tip end portion of the needle electrode and opposed to each other at a distance from each other on opposing sides of the needle electrode.

Preferably, a hole through which air toward the needle electrode passes is provided in at least one of the first protection portion and the second protection portion.

Preferably, the insulating sealing portion has an electrode sealing region sealing a part of the needle electrode and the electrode sealing region is exposed to the outside of the housing.

Preferably, a root side of the electrode protection portion is sealed with the insulating sealing portion.

Preferably, an induction electrode provided in the housing and forming electric field between the induction electrode and the needle electrode is further provided. The induction electrode is sealed with the insulating sealing portion.

Preferably, the first protection portion and the second protection portion are separate from each other in a region not sealed with the insulating sealing portion.

Preferably, the needle electrode has a positive ion generation electrode generating positive ions and a negative ion generation electrode generating negative ions. The insulating sealing portion has a positive-side insulating sealing portion sealing a part of a shaft center portion of the positive ion generation electrode and a negative-side insulating sealing portion sealing a part of a shaft center portion of the negative ion generation electrode. The positive-side insulating sealing portion and the negative-side insulating sealing portion are provided at a prescribed distance from each other.

Electric equipment according to this invention includes the ion generation apparatus described above and an air blower sending ions generated from the ion generation apparatus to the outside.

Advantageous Effects of Invention

According to this invention, a finger is less likely to touch a needle electrode and a needle electrode can readily be cleaned.

DESCRIPTION OF EMBODIMENTS

First Embodiment

Figure 1:
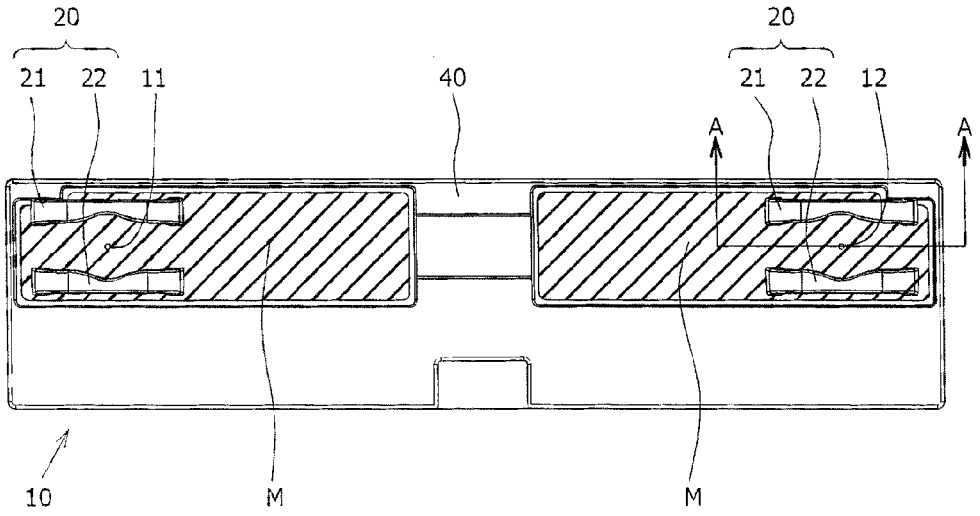
FIG. 1 is a front view of an ion generation apparatus according to a first embodiment of the present invention.
Figure 2:
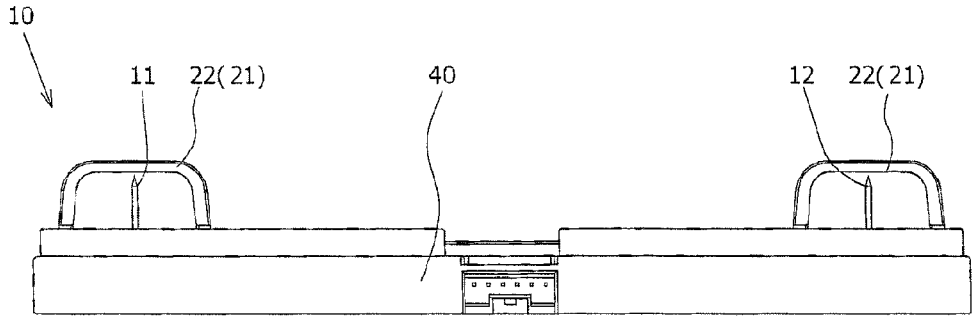
FIG. 2 is a bottom view of the ion generation apparatus according to the first embodiment of the present invention.
Figure 3:
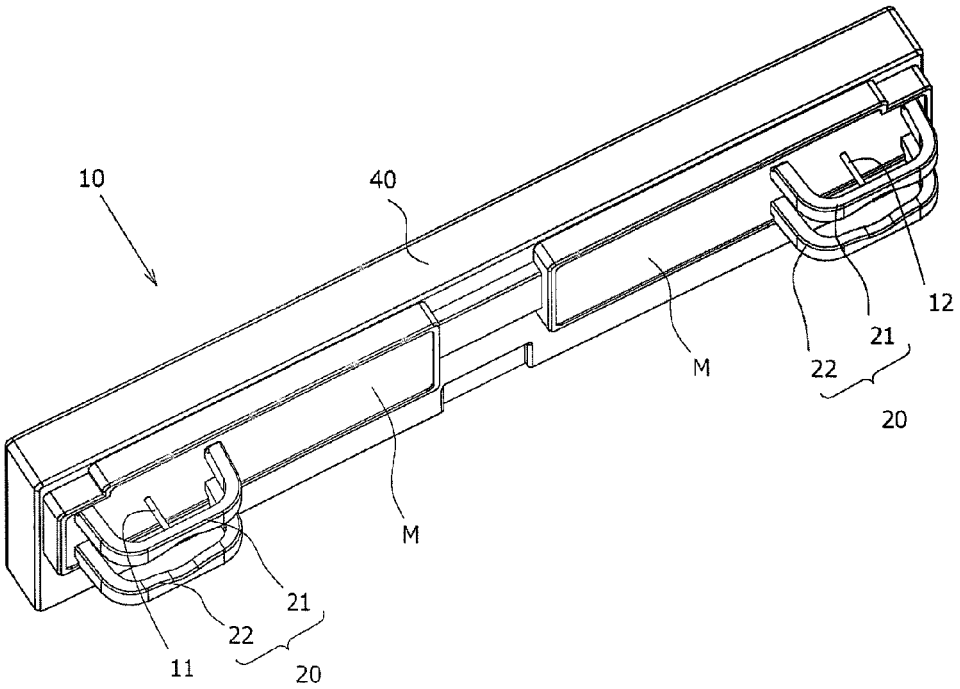
FIG. 3 is a perspective view of the ion generation apparatus according to the first embodiment of the present invention.
Figure 4:
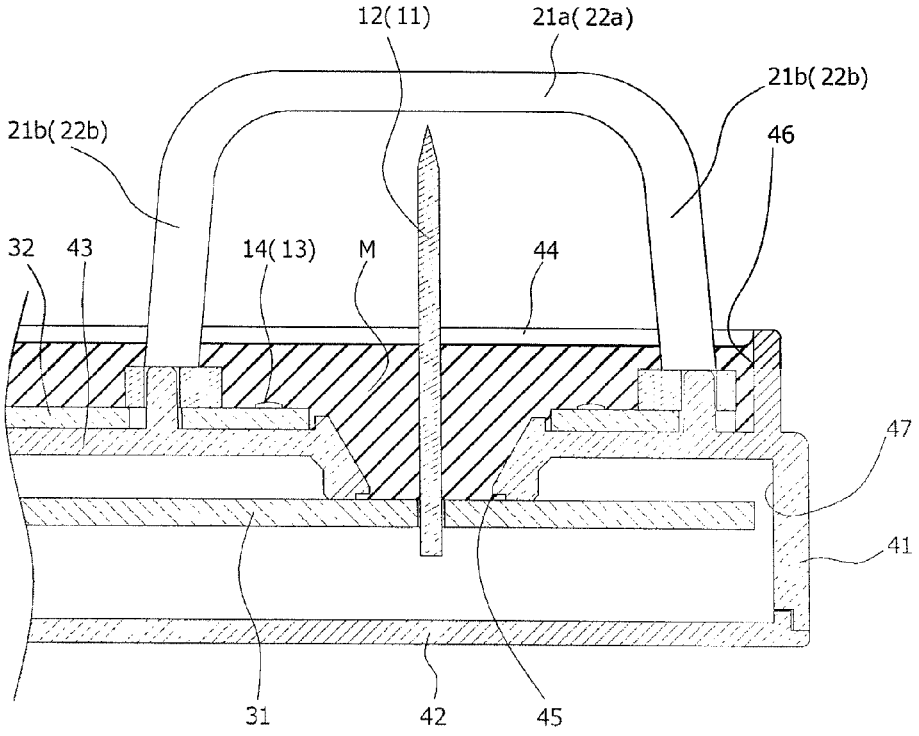
FIG. 4 is a cross-sectional view along the line A-A in FIG. 1.

FIG. 1 is a front view of an ion generation apparatus according to an embodiment of the present invention. FIGS. 2 and 3 are a bottom view and a perspective view, respectively. FIG. 4 is a cross-sectional view along the line A-A in FIG. 1.

The ion generation apparatus mainly includes a needle electrode 11 for generating positive ions, a needle electrode 12 for generating negative ions, an induction electrode 13 for forming electric field between the induction electrode and needle electrode 11, an induction electrode 14 for forming electric field between the induction electrode and needle electrode 12, printed circuit boards 31 and 32, a housing 40 in a substantially parallelepiped shape, and an electrode protection portion 20 covering a tip end portion of each of needle electrodes 11 and 12.

Housing 40 is in a substantially rectangular shape in a front view and is constituted of a housing main body 41 and a lid body 42. Housing main body 41 has a substrate placement surface 43 in a substantially rectangular shape in a plan view and a housing wall surface 46 extends from each of four sides of one surface (a lower surface in FIG. 4) of substrate placement surface 43. The housing main body is formed by substrate placement surface 43 and housing wall surface 46, in a shape of a box of which bottom opens. On the other surface (an upper surface in FIG. 4) of substrate placement surface 43, a wall surface 47 extends along each of opposing sides in a longitudinal direction of housing 40 so as to form a quadrangular prism. An opening portion 44 surrounded by wall surfaces 47 on opposing sides in the longitudinal direction of housing 40 is formed in housing 40. Housing 40 further has lid body 42 in a substantially rectangular plate shape. Lid body 42 covers an opening formed in a lower portion of the housing main body.

Printed circuit boards 31 and 32 are arranged in parallel one above the other in FIG. 4, at a prescribed distance from each other in housing 40. Printed circuit board 31 is in a substantially rectangular shape and arranged on one surface side of substrate placement surface 43. Printed circuit board 32 is in a substantially rectangular shape and arranged on the other surface side of substrate placement surface 43. Printed circuit boards 31 and 32 are arranged such that substrate placement surface 43 lies therebetween.

Needle electrodes 11 and 12 are provided perpendicularly to printed circuit boards 31 and 32. Namely, a base end portion (a root portion) of needle electrode 11 is inserted into a hole in printed circuit board 31, and a shaft center portion thereof passes through the center of a hole 45 provided in housing 40 and the center of a hole 32*a* in printed circuit board 32. A base end portion of needle electrode 12 is inserted and fitted into a hole in printed circuit board 31 and a shaft center portion thereof passes through the center of hole 45 provided in housing 40 and the center of hole 32*a* in printed circuit board 32. Hole 45 provided in housing 40 through printed circuit board 31 is closed. The base end portion of each of needle electrodes 11 and 12 is fixed to printed circuit board 31 with solder.

A tip end portion of each of needle electrodes 11 and 12 is sharply pointed. A printed circuit board may be divided into a plurality of pieces and needle electrode 11 and needle electrode 12 may be provided in different substrates, respectively. Needle electrode 11 and needle electrode 12 are provided on printed circuit board 31 at a prescribed distance from each other. In the present embodiment, a distance between needle electrode 11 and needle electrode 12 is set to 102 mm. The tip end portion of each of needle electrodes 11 and 12 does not have to be sharply pointed.

Induction electrodes 13 and 14 are annularly formed to surround needle electrodes 11 and 12, respectively, with an interconnection layer of printed circuit board 31 on a surface in one end portion and the other end portion in the longitudinal direction of printed circuit board 32. On an inner side of each of induction electrodes 13 and 14, hole 32*a* passing through printed circuit board 32 is opened. The induction electrode does not have to annularly be formed.

Two electrode protection portions 20 are provided to correspond to needle electrode 11 at the one end portion and needle electrode 12 at the other end portion in the longitudinal direction of housing 40, respectively. Each electrode protection portion has a first protection portion 21 and a second protection portion 22 opposed to each other at a distance from each other on opposing sides of the tip end portion of each of needle electrodes 11 and 12. First protection portion 21 and second protection portion 22 are juxtaposed, with each of needle electrodes 11 and 12 lying therebetween, in a direction of a short side of housing 40. First protection portion 21 and second protection portion 22 protrude outward from housing 40 and protrude outward relative to needle electrodes 11 and 12.

First protection portion 21 and second protection portion 22 are constituted of a top plate 21*a* and a support portion 21*b* and a top plate 22*a* and a support portion 22*b*, respectively. Top plates 21*a* and 22*a* are each in a strip shape, and two support portions 21*b* and two support portions 22*b* extend from opposing ends of each of top plates 21*a* and 22*a* toward housing 40. First protection portion 21*a* and second protection portion 22*b* form an arch shape, and an opening is formed between two support portions 21*b*, 22*b*. When the ion generation apparatus in the present embodiment is viewed in the direction of the short side of housing 40, tip ends of needle electrodes 11 and 12 can visually be recognized through the openings provided between support portions 21*b*, 22*b*.

Namely, with a direction of a long side of housing 40, a direction of a short side of housing 40, and a direction in which needle electrodes 11 and 12 protrude from housing 40 being defined as an X direction, a Y direction, and a Z direction, respectively, two needle electrodes 11 and 12 are disposed in the X direction, pointing to the Z direction, and they protrude from housing 40. An opening is provided in electrode protection portion 20 such that needle electrodes 11 and 12 can be seen in the Y direction. Though the opening is provided such that needle electrodes 11 and 12 can be seen in the Y direction in the present embodiment, an opening may be provided such that needle electrodes 11 and 12 can be seen in the X direction.

Electrode protection portion 20 is arranged such that support portions 21*b* and 22*b* are placed on a surface of printed circuit board 32 and printed circuit board 32 lies between electrode protection portion 20 and substrate placement surface 43. Though not shown, support portions 21*b* and 22*b* are formed integrally as being connected to each other at an end portion on a side of housing 40 (on a root side). Support portions 21*b* and 22*b* may be formed as members completely independent of each other.

Printed circuit board 31 is provided to close hole 45 provided in housing 40 from one surface side of substrate placement surface 43 (opposite to a side where the tip end portions of needle electrodes 11 and 12 protrude). Thus, a space surrounded by substrate placement surface 43 and wall surface 47 is hermetically sealed except for opening portion 44. An insulating sealing portion M is formed by filling the space with an epoxy resin through opening portion 44 so as to seal opening portion 44. In FIGS. 1 and 4, insulating sealing portion M is shown with hatching.

Printed circuit board 32 and induction electrodes 13 and 14 are sealed with insulating sealing portion M. A side of the base end portions of discharge electrodes 11 and 12 is sealed with insulating sealing portion M. A root side of each of first protection portion 21 and the second protection portion is sealed with insulating sealing portion M. Though support portion 21*b* of first protection portion 21 and support portion 22*b* of second protection portion 22 are integrated at the end portions as being connected to each other in the present embodiment, the integrated portion is sealed with insulating sealing portion M. An insulating sealing material is not limited to an epoxy resin, and other materials for insulation and sealing may be employed.

In the present embodiment, as shown in FIGS. 1 and 3, insulating sealing portion M is provided independently, on a side where needle electrode 11 for generating positive ions is provided and on a side where needle electrode 12 for generating negative ions is provided. The insulating sealing portion for sealing of the side of the base end portion of needle electrode 11 is provided at a distance from the insulating sealing portion for sealing of the side of the base end portion of needle electrode 12.

In a space surrounded by housing main body 41 and lid body 42, printed circuit board 31 and such circuit components as a power supply circuit 33, a step-up transformer 34, and diodes 35 and 36 which will be described later are provided. Since the step-up transformer generating a high voltage is arranged in the space surrounded by housing main body 41 and lid body 42, it is insulated and sealed with the epoxy resin. An insulating sealing material is not limited to an epoxy resin, and other materials for insulation and sealing may be employed.

Figure 5:
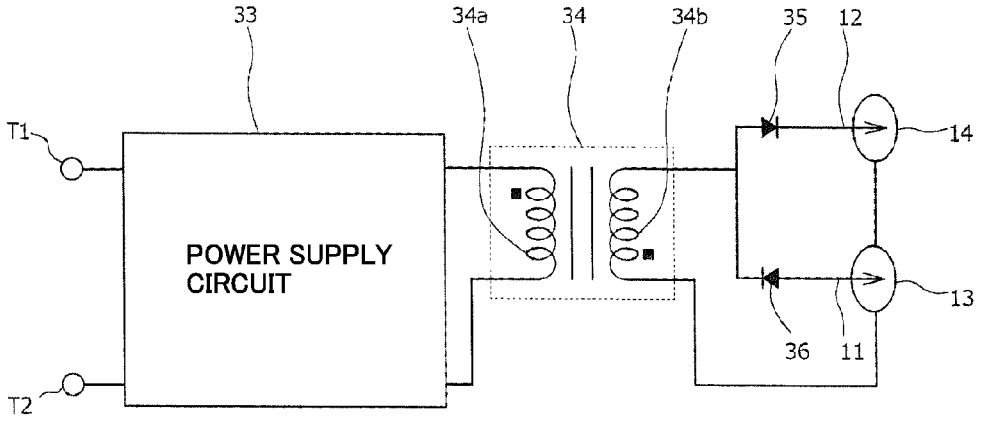
FIG. 5 is a circuit diagram showing a configuration of the ion generation apparatus shown in FIG. 1.

FIG. 5 is a circuit diagram showing a configuration of the ion generation apparatus in the present embodiment. In FIG. 5, the ion generation apparatus includes, in addition to needle electrodes 11 and 12 and induction electrodes 13 and 14, a power supply terminal T1, a ground terminal T2, diodes 35 and 36, and step-up transformer 34. A portion other than needle electrodes 11 and 12 and induction electrodes 13 and 14 in the circuit in FIG. 5 is not shown.

A positive electrode and a negative electrode of a direct-current power supply are connected to power supply terminal T1 and ground terminal T2, respectively. A direct-current power supply voltage (for example, +12 V or +15 V) is applied to power supply terminal T1 and ground terminal T2 is grounded. Power supply terminal T1 and ground terminal T2 are connected to step-up transformer 34 with power supply circuit 33 being interposed.

Step-up transformer 34 includes a primary winding 34*a* and a secondary winding 34*b*. Secondary winding 34*b* has one terminal connected to induction electrodes 13 and 14 and the other terminal connected to an anode of diode 35 and a cathode of diode 36. Diode 35 has a cathode connected to the base end portion on the root side of needle electrode 11 and diode 36 has an anode connected to the base end portion on the root side of needle electrode 12.

An operation of this ion generation apparatus will now be described. When a direct-current power supply voltage is applied across power supply terminal T1 and ground terminal T2, charges are charged in a capacitor (not shown) of power supply circuit 33. Charges charged in the capacitor are discharged through primary winding 34*a* of step-up transformer 34 so that an impulse voltage is generated in primary winding 34*a*.

When the impulse voltage is generated in primary winding 34*a*, positive and negative high-voltage pulses are produced in secondary winding 34*b* as being alternately attenuating. The positive high-voltage pulses are applied to needle electrode 11 through diode 35, and negative high-voltage pulses are applied to needle electrode 12 through diode 36. Thus, corona discharge occurs at the tip ends of needle electrodes 11 and 12 so that positive ions and negative ions are generated.

Positive ions are such cluster ions that a plurality of water molecules are clustered around hydrogen ion ($H^+$) and expressed as $H^+(H_2O)_m$ (m being any natural number). Negative ions are such cluster ions that a plurality of water molecules are clustered around oxygen ion ($O_2^-$) and expressed as $O_2^-(H_2O)_n$ (n being 0 or any natural number). When positive ions and negative ions are emitted to a room, both ions surround mold fungi or viruses floating in the air, and chemically react with each other on surfaces thereof. As a result of action of hydroxyl radicals (.OH) which are active species generated at that time, airborne mold fungi and the like are removed.

Figure 6:
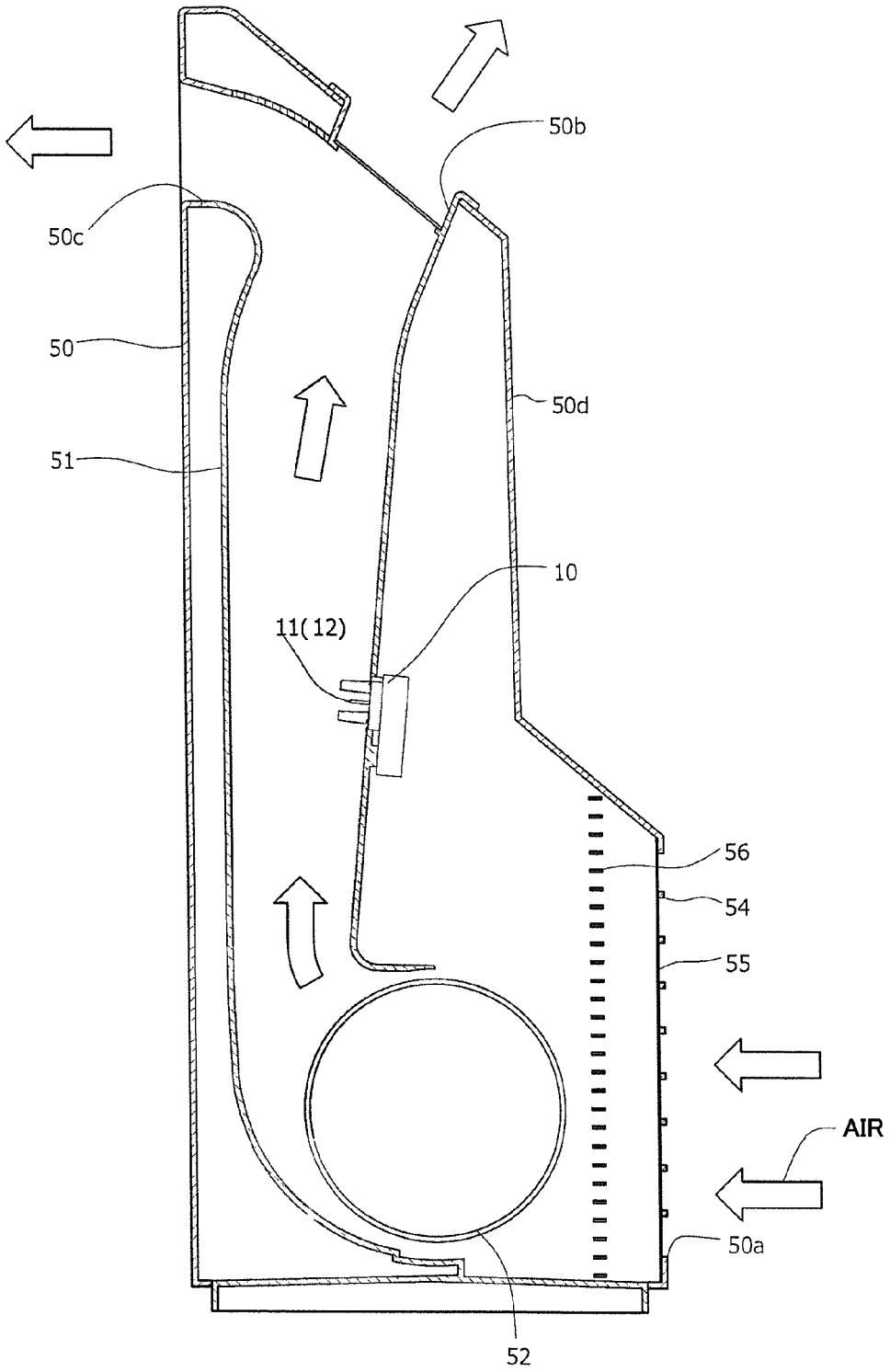
FIG. 6 is a cross-sectional view showing a construction of an air cleaner including the ion generation apparatus shown in FIG. 1.

FIG. 6 is a cross-sectional view showing a construction of an air cleaner including the ion generation apparatus shown in FIGS. 1 to 4. In FIG. 6, in this air cleaner, a suction port 50*a* is provided in a rear surface in a lower portion of a main body 50, and outlets 50*b* and 50*c* are provided in the rear surface and a front surface in an upper portion of main body 50, respectively. A duct 51 is provided in main body 50. An opening portion at a lower end of duct 51 is provided to be opposed to suction port 50*a* and an upper end of duct 51 is connected to outlets 50*b* and 50*c*.

A cross flow fan 52 is provided in the opening portion at the lower end of duct 51, and ion generation apparatus 10 is provided in a central portion of duct 51. Ion generation apparatus 10 is as shown in FIGS. 1 to 4. Housing 40 of ion generation apparatus 10 is fixed to an outer wall surface of duct 51, and needle electrodes 11 and 12 and electrode protection portion 12 thereof pass through a wall of duct 51 to protrude into duct 51. Two needle electrodes 11 and 12 are disposed in a direction (the X direction) orthogonal to a direction (the Y direction) in which air flows in duct 51.

A grid-like grille 54 made of a resin is provided in outlet 50*a*, and a meshed thin filter 55 is attached to an inner side of grille 54. In the rear of filter 55, a fan guard 56 is provided such that a foreign matter or a finger of a user does not enter cross flow fan 52.

As cross flow fan 52 is rotationally driven, air in a room is suctioned into duct 51 through suction port 50*a*. Mold fungi contained in suctioned air are removed by ions generated by ion generation apparatus 10. Air which has passed through ion generation apparatus 10 is emitted to the room together with ions through outlets 50*b* and 50*c*.

When a high voltage is applied to needle electrodes 11 and 12, electric field is formed between needle electrodes 11 and 12 and induction electrodes 13 and 14, corona discharge occurs at the tip end portions of needle electrodes 11 and 12, and ions are generated. Here, when electrode protection portion 20 is present in the immediate vicinity of the tip end of each of needle electrodes 11 and 12, electric field generated between needle electrodes 11 and 12 and induction electrodes 13 and 14 is interfered. In the present embodiment, however, first protection portion 21 and second protection portion 22 are arranged to be opposed to each other at a distance from each other on the opposing sides of the tip end portion of each of needle electrodes 11 and 12, and a portion around the tip end portion of each of needle electrodes 11 and 12 is not blocked. Thus, interference of electric field generated between needle electrodes 11 and 12 and induction electrodes 13 and 14 by electrode protection portion 20 can be suppressed.

Ion generation apparatus 10 is replaced by a user after operation for a prescribed period of time. When the user replaces ion generation apparatus 10, the user can access ion generation apparatus 10 installed in duct 51 by removing a lid body 50*d* present on the rear surface of main body 50 of an air cleaning apparatus. Here, first protection portion 21 and second protection portion 22 protrude outward relative to the tip end portions of needle electrodes 11 and 12. Therefore, even when the user holds ion generation apparatus 10, a finger of the user comes in contact with first protection portion 21 and second protection portion 22 and is less likely to touch the tip end portions of needle electrodes 11 and 12, without injuring the finger of the user.

Some ion generation apparatuses do not require replacement by users. In that case as well, with ion generation apparatus 10 according to the invention of the present application, an operator will not touch the tip end portions of needle electrodes 11 and 12 and not injure his/her finger during manufacturing.

As set forth above, since the tip end portions of needle electrodes 11 and 12 protrude from housing 40, ions generated at the tip end portions of needle electrodes 11 and 12 can efficiently be emitted to the outside of housing 40. Since electrode protection portion 20 covering the tip end portion of each of needle electrodes 11 and 12 from opposing sides is provided, a user can be prevented from touching the tip end portion of each of needle electrodes 11 and 12 and injuring his/her finger.

Since each of needle electrodes 11 and 12 lies between first protection portion 21 and second protection portion 22*b* such that the tip ends of needle electrodes 11 and 12 can be seen in the Z direction, interference by electrode protection portion 20, of electric field produced around the tip end portions of needle electrodes 11 and 12 and resultant decrease in amount of ion generation can be prevented. Since an opening is provided in electrode protection portion 20 such that needle electrodes 11 and 12 can be seen in the Y direction, ions can efficiently be sent by sending air in the Y direction.

Since a high voltage is applied to needle electrodes 11 and 12, charged dust around the needle electrode may be attracted to and deposited on the needle electrode. When deposits are accumulated on needle electrodes 11 and 12, not only corona discharge is less likely to take place but also such accumulation may become a cause of occurrence of abnormal discharge or leakage of a current between needle electrodes 11 and 12 and housing 40 or between needle electrodes 11 and 12 and induction electrodes 13 and 14.

More specifically, as deposits on needle electrodes 11 and 12 are accumulated, a spatial distance between needle electrodes 11 and 12 and housing 40 is shorter. Here, when a high voltage is applied to needle electrodes 11 and 12, breakdown occurs between needle electrodes 11 and 12 and housing 40, which results in leakage. This phenomenon is more likely in particular when a large amount of impurities is contained in air in a space where the ion generation apparatus is used.

Opening portion 44 in housing 40 is sealed with insulating sealing portion M and a gap through which dust enters the inside of housing 40 is buried. Since a side of a root portion of needle electrodes 11 and 12 is sealed as being enclosed by insulating sealing portion M, the side of the base end portion of each of needle electrodes 11 and 12 is completely buried in insulating sealing portion M as shown in FIG. 3 when opening portion 44 is viewed from the outside of housing 40.

Namely, a portion around the shaft center portion of needle electrodes 11 and 12 is sealed with insulating sealing portion M and a structure is such that no impurity enters the inside of housing 40. Thus, a leakage phenomenon due to accumulation of impurities between needle electrodes 11 and 12 and components provided in housing 40 represented by induction electrodes 13 and 14 can be prevented and ions can be generated in a stable manner.

In general, a leakage phenomenon due to accumulation of deposits may take place similarly between needle electrodes 11 and 12 and induction electrodes 13 and 14. In the present embodiment, however, printed circuit board 31 provided with needle electrodes 11 and 12 and printed circuit board 32 provided with induction electrodes 13 and 14 are sealed with insulating sealing portion M, and no deposits accumulate between needle electrodes 11 and 12 and induction electrodes 13 and 14. A leakage phenomenon between needle electrodes 11 and 12 and induction electrodes 13 and 14 can thus be prevented.

In the present embodiment, insulating sealing portion M is provided such that an insulating sealing portion on a positive ion side for sealing of a part (the side of the base end portion) of needle electrode 11 for generating positive ions and an insulating sealing portion on a negative ion side for sealing of a part (the side of the base end portion) of needle electrode 12 for generating negative ions are at a prescribed distance from each other, independently of each other. Thus, a side where needle electrode 11 generating positive ions is provided and a side where needle electrode 12 generating negative ions is provided are sealed with different insulating sealing portions. Namely, electrodes different in polarity from each other are not sealed with the same single insulating sealing portion. Therefore, creepage surface leakage which may occur at the surface of the insulating sealing portion can be prevented.

First protection portion 21 and second protection portion 22 are arranged to be opposed to each other at a distance from each other on opposing sides of the tip end portion of each of needle electrodes 11 and 12. Thus, needle electrodes 11 and 12 can efficiently be cleaned by passing such a cleaning member as a cleaning brush between first protection portion 21 and second protection portion 22.

The user can readily clean needle electrodes 11 and 12 as the cleaning brush is guided by the first protection portion and the second protection portion. Not only the tip end portions of needle electrodes 11 and 12 but also a shaft core portion other than the tip end portions of needle electrodes 11 and 12 can also be cleaned.

Insulating sealing portion M for insulation and sealing of the side of the base end portions of needle electrodes 11 an 12 is exposed through opening portion 44 in housing 40. A portion on the root side of the shaft center portion of needle electrodes 11 and 12 which protrudes from insulating sealing portion M can also readily be cleaned. Since an exposed surface of insulating sealing portion M is very high in smoothness, it can readily be cleaned with the cleaning brush.

Since induction electrodes 13 and 14 are formed with an interconnection layer of printed circuit board 32, induction electrodes 13 and 14 can be formed with low cost, so that reduction in cost of the ion generation apparatus can be achieved.

Though induction electrodes 13 and 14 are formed with the interconnection layer of printed circuit board 32 in the present embodiment, induction electrodes 13 and 14 may be formed from a metal plate. Each of induction electrodes 13 and 14 does not have to be annular.

Though the construction of the air cleaner including the ion generation apparatus in the present embodiment is shown in FIG. 6, electric equipment including the ion generation apparatus in the present embodiment includes, for example, an air conditioner, an ion generator, a dehumidifier, a humidifier, a refrigerator, a fan heater, a washer and dryer, a sweeper, and a sterilizer, in addition to the air cleaner.

Second Embodiment

Figure 7:
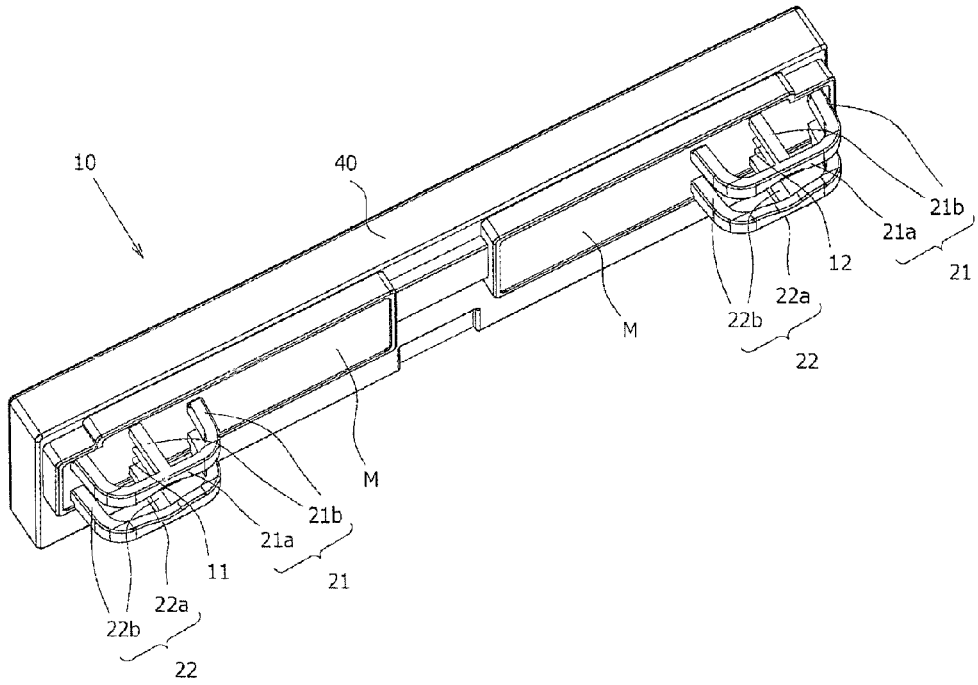
FIG. 7 is a perspective view of an ion generation apparatus according to a second embodiment of the present invention.

FIG. 7 is a perspective view of an ion generation apparatus according to a second embodiment of the present invention, which is compared with FIG. 3. This ion generation apparatus in FIG. 7 is different from the ion generation apparatus in FIG. 3 in a shape of electrode protection portion 20. Since features other than electrode protection portion 20 are the same as in the ion generation apparatus in the first embodiment, description will not be provided.

Two electrode protection portions 20 are provided to correspond to needle electrode 11 at the one end portion and needle electrode 12 at the other end portion in the longitudinal direction of housing 40, respectively. Each electrode protection portion has first protection portion 21 and second protection portion 22 opposed to each other at a distance from each other on opposing sides of the tip end portion of each of needle electrodes 11 and 12. First protection portion 21 and second protection portion 22 are juxtaposed, with each of needle electrodes 11 and 12 lying therebetween, in the direction of the short side of housing 40. First protection portion 21 and second protection portion 22 protrude outward from housing 40 and protrude outward relative to needle electrodes 11 and 12.

First protection portion 21 and second protection portion 22 are constituted of top plate 21*a* and support portion 21*b* and top plate 22*a* and support portion 22*b*, respectively. Top plates 21*a* and 22*a* are each in a strip shape, and each of support portions 21*b* and support portions 22*b* extends from three portions, that is, opposing ends of each of top plates 21*a* and 22*a* and a central portion thereof, toward housing 40. First protection portion 21*a* and second protection portion 22*b* form such a structure that they further each include a column in a central portion of the arch shape and two openings are formed between three support portions 21*b*, 22*b*. When the ion generation apparatus in the present embodiment is viewed in the direction of the short side of housing 40, tip ends of needle electrodes 11 and 12 are hidden by support portion 22*b* serving as the central column. When air passes through the openings provided in support portions 21*b* and 22*b*, however, air flows in the immediate vicinity of needle electrodes 11 and 12 and hence ions are efficiently generated.

Third Embodiment

Figure 8:
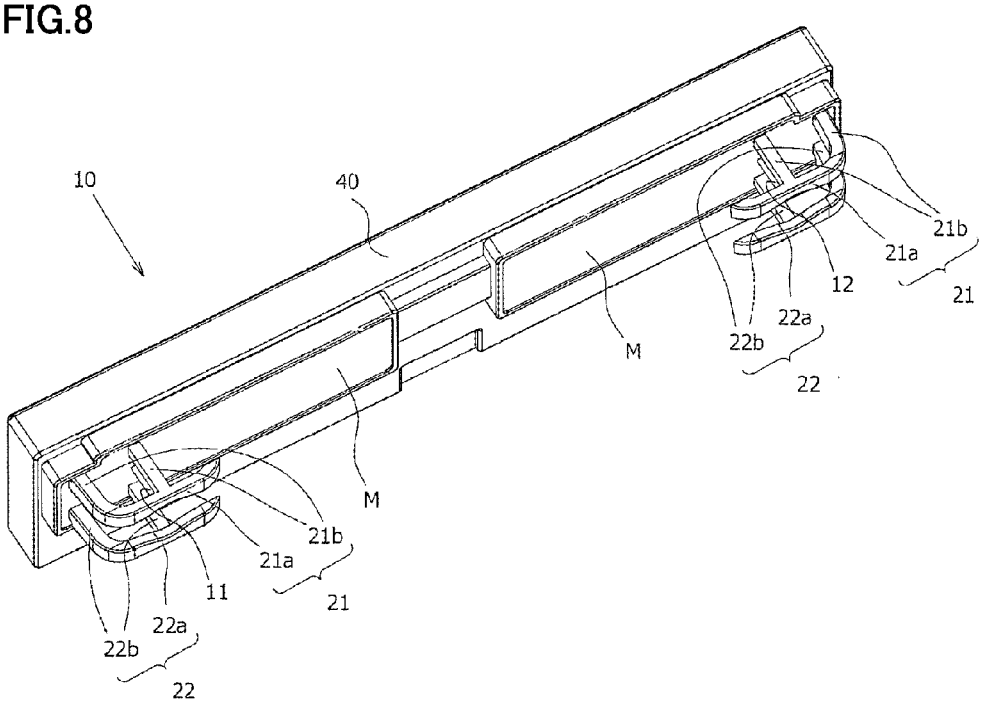
FIG. 8 is a perspective view of an ion generation apparatus according to a third embodiment of the present invention.

FIG. 8 is a perspective view of an ion generation apparatus according to a third embodiment of the present invention, which is compared with FIG. 3. This ion generation apparatus in FIG. 8 is different from the ion generation apparatus in FIG. 3 in a shape of electrode protection portion 20. Since features other than electrode protection portion 20 are the same as in the ion generation apparatus in the first embodiment, description will not be provided.

Two electrode protection portions 20 are provided to correspond to needle electrode 11 at the one end portion and needle electrode 12 at the other end portion in the longitudinal direction of housing 40, respectively. Each electrode protection portion has first protection portion 21 and second protection portion 22 opposed to each other at a distance from each other on opposing sides of the tip end portion of each of needle electrodes 11 and 12. First protection portion 21 and second protection portion 22 are juxtaposed, with each of needle electrodes 11 and 12 lying therebetween, in the direction of the short side of housing 40. First protection portion 21 and second protection portion 22 protrude outward from housing 40 and protrude outward relative to needle electrodes 11 and 12.

First protection portion 21 and second protection portion 22 are constituted of top plate 21*a* and support portion 21*b* and top plate 22*a* and support portion 22*b*, respectively. Top plates 21*a* and 22*a* are each in a strip shape, and each of support portions 21*b* and support portions 22*b* extends from three portions, that is, opposing ends of top plates 21*a* and 22*a* and a central portion thereof, toward housing 40. First protection portion 21*a* and second protection portion 22*b* form such a structure that they each further include a column in a central portion in the arch shape and two openings are formed between three support portions 21*b*, 22*b*. When the ion generation apparatus in the present embodiment is viewed in the direction of the short side of housing 40, tip ends of needle electrodes 11 and 12 are hidden by support portion 22*b* serving as the central column. When air passes through the openings provided in support portions 21*b* and 22*b*, however, air flows in the immediate vicinity of needle electrodes 11 and 12 and hence ions are efficiently generated.

Fourth Embodiment

Figure 9:
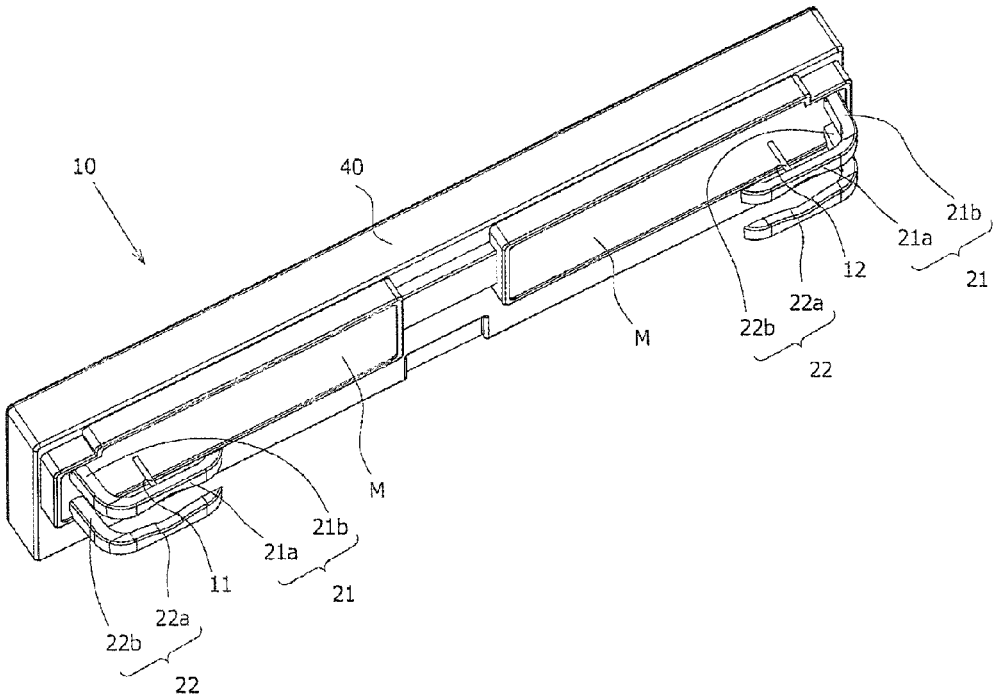
FIG. 9 is a perspective view of an ion generation apparatus according to a fourth embodiment of the present invention.

FIG. 9 is a perspective view of an ion generation apparatus according to a fourth embodiment of the present invention, which is compared with FIG. 3. This ion generation apparatus in FIG. 9 is different from the ion generation apparatus in FIG. 3 in a shape of electrode protection portion 20. Since features other than electrode protection portion 20 are the same as in the ion generation apparatus in the first embodiment, description will not be provided.

Two electrode protection portions 20 are provided to correspond to needle electrode 11 at the one end portion and needle electrode 12 at the other end portion in the longitudinal direction of housing 40, respectively. Each electrode protection portion has first protection portion 21 and second protection portion 22 opposed to each other at a distance from each other on opposing sides of the tip end portion of each of needle electrodes 11 and 12. First protection portion 21 and second protection portion 22 are juxtaposed, with each of needle electrodes 11 and 12 lying therebetween, in the direction of the short side of housing 40. First protection portion 21 and second protection portion 22 protrude outward from housing 40 and protrude outward relative to needle electrodes 11 and 12.

First protection portion 21 and second protection portion 22 are constituted of top plate 21*a* and support portion 21*b* and top plate 22*a* and support portion 22*b*, respectively. Top plates 21*a* and 22*a* are each in a strip shape, and support portions 21*b* and 22*b* extend from one ends of top plates 21*a* and 22*a* toward housing 40, respectively. First protection portion 21*a* and second protection portion 22*b* form an L shape and an opening is formed under top plates 21*a* and 22*a* (on a side of housing 40). When the ion generation apparatus in the present embodiment is viewed in the direction of the short side of housing 40, the tip ends of needle electrodes 11 and 12 can visually be recognized through the opening described previously.

Fifth Embodiment

Figure 10:
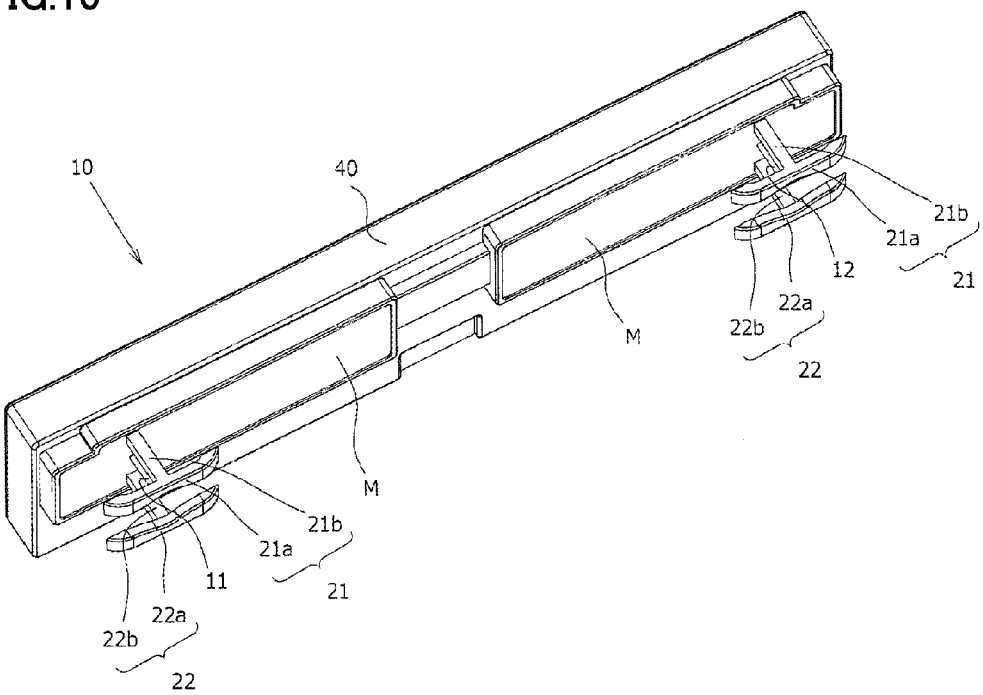
FIG. 10 is a perspective view of an ion generation apparatus according to a fifth embodiment of the present invention.

FIG. 10 is a perspective view of an ion generation apparatus according to a fifth embodiment of the present invention, which is compared with FIG. 3. This ion generation apparatus in FIG. 10 is different from the ion generation apparatus in FIG. 3 in a shape of electrode protection portion 20. Since features other than electrode protection portion 20 are the same as in the ion generation apparatus in the first embodiment, description will not be provided.

Two electrode protection portions 20 are provided to correspond to needle electrode 11 at the one end portion and needle electrode 12 at the other end portion in the longitudinal direction of housing 40, respectively. Each electrode protection portion has first protection portion 21 and second protection portion 22 opposed to each other at a distance from each other on opposing sides of the tip end portion of each of needle electrodes 11 and 12. First protection portion 21 and second protection portion 22 are juxtaposed, with each of needle electrodes 11 and 12 lying therebetween, in the direction of the short side of housing 40. First protection portion 21 and second protection portion 22 protrude outward from housing 40 and protrude outward relative to needle electrodes 11 and 12.

First protection portion 21 and second protection portion 22 are constituted of top plate 21*a* and support portion 21*b* and top plate 22*a* and support portion 22*b*, respectively. Top plates 21*a* and 22*a* are each in a strip shape, and support portion 21*b* and support portion 22*b* each extend from a central portion of each of top plates 21*a* and 22*a* toward housing 40. First protection portion 21*a* and second protection portion 22*b* form a T shape and openings are formed at opposing ends of each of support portions 21*b* and 22*b* in a region under each of top plates 21*a* and 22*a* (on the side of housing 40). When the ion generation apparatus in the present embodiment is viewed in the direction of the short side of housing 40, the tip ends of needle electrodes 11 and 12 are hidden by support portion 22*b* serving as the central column. When air passes through the openings provided in support portions 21*b* and 22*b*, however, air flows in the immediate vicinity of needle electrodes 11 and 12 and hence ions are efficiently generated.

Sixth Embodiment

Figure 11:
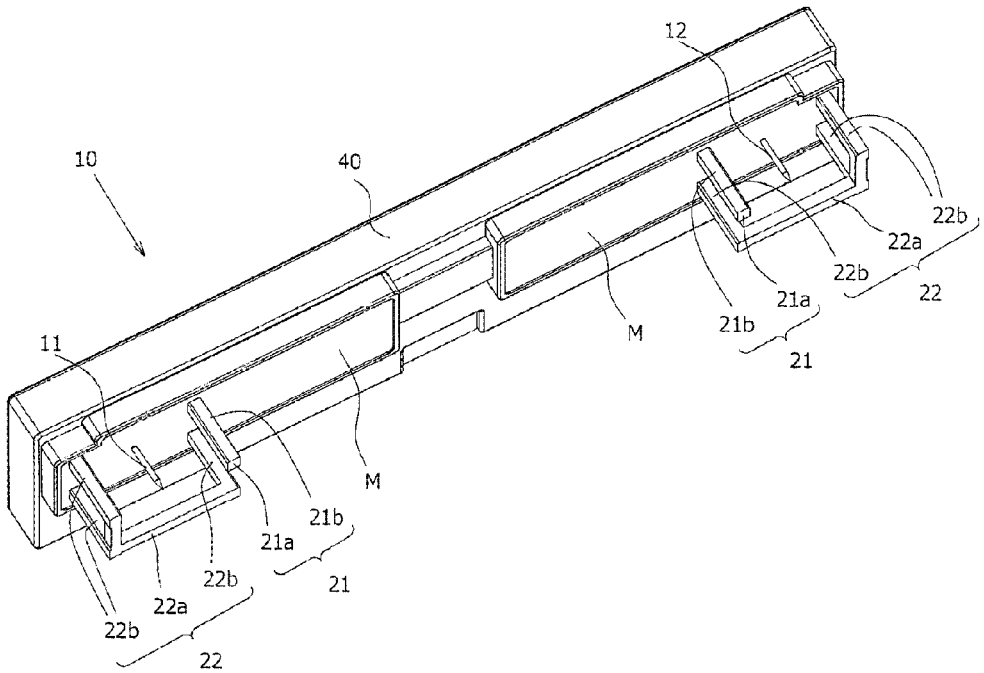
FIG. 11 is a perspective view of an ion generation apparatus according to a sixth embodiment of the present invention.

FIG. 11 is a perspective view of an ion generation apparatus according to a sixth embodiment of the present invention, which is compared with FIG. 3. This ion generation apparatus in FIG. 11 is different from the ion generation apparatus in FIG. 3 in a shape of electrode protection portion 20. Since features other than electrode protection portion 20 are the same as in the ion generation apparatus in the first embodiment, description will not be provided.

Two electrode protection portions 20 are provided to correspond to needle electrode 11 at the one end portion and needle electrode 12 at the other end portion in the longitudinal direction of housing 40, respectively. Each electrode protection portion has first protection portion 21 and second protection portion 22 opposed to each other at a distance from each other on opposing sides of the tip end portion of each of needle electrodes 11 and 12. First protection portion 21 and second protection portion 22 are juxtaposed with each of needle electrodes 11 and 12 lying therebetween. First protection portion 21 and second protection portion 22 protrude outward from housing 40 and protrude outward relative to needle electrodes 11 and 12.

First protection portion 21 and second protection portion 22 are constituted of top plate 21*a* and support portion 21*b* and top plate 22*a* and support portion 22*b*, respectively. First protection portion 21 is in a rod shape, in which the tip end portion is implemented as top plate 21 and a portion other than the tip end portion is implemented as support portion 21*b*. Top plate 22*b* of second protection portion 22 is in an L plate shape, and support portion 22*b* extends from three portions, that is, opposing end portions of top plate 22*b* and a bent portion of the L shape, toward housing 40. Two openings are formed between three support portions 22*b*. When the ion generation apparatus in the present embodiment is viewed in the direction of the short side of housing 40, the tip ends of needle electrodes 11 and 12 can visually be recognized through the opening provided between support portions 22*b*. When the ion generation apparatus in the present embodiment is viewed in the longitudinal direction of housing 40 as well, the tip ends of needle electrodes 11 and 12 can visually be recognized through the opening provided between support portions 22*b*.

First protection portion 21 and second protection portion 22 are arranged to be opposed to each other at a distance from each other on opposing sides of the tip end portion of each of needle electrodes 11 and 12. Thus, needle electrodes 11 and 12 can efficiently be cleaned by passing such a cleaning member as a cleaning brush between first protection portion 21 and second protection portion 22. In the ion generation apparatus according to the present embodiment, needle electrodes 11 and 12 can efficiently be cleaned by passing the cleaning brush in an L shape instead of linearly passing the cleaning brush.

Seventh Embodiment

Figure 12:
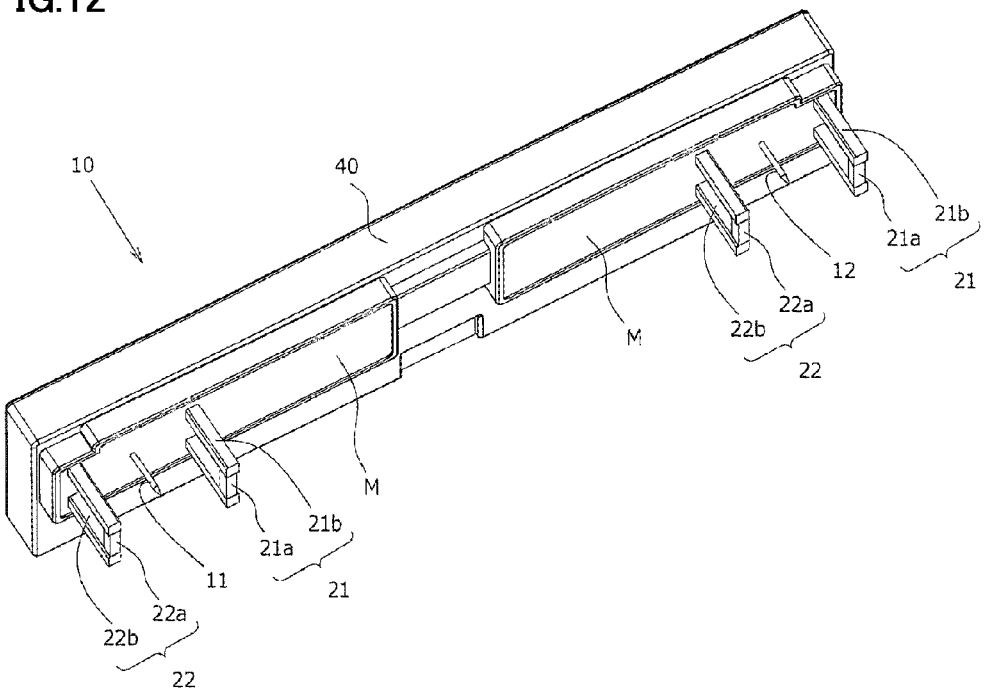
FIG. 12 is a perspective view of an ion generation apparatus according to a seventh embodiment of the present invention.

FIG. 12 is a perspective view of an ion generation apparatus according to a seventh embodiment of the present invention, which is compared with FIG. 3. This ion generation apparatus in FIG. 12 is different from the ion generation apparatus in FIG. 3 in a shape of electrode protection portion 20. Since features other than electrode protection portion 20 are the same as in the ion generation apparatus in the first embodiment, description will not be provided.

Two electrode protection portions 20 are provided to correspond to needle electrode 11 at the one end portion and needle electrode 12 at the other end portion in the longitudinal direction of housing 40, respectively. Each electrode protection portion has first protection portion 21 and second protection portion 22 opposed to each other at a distance from each other on opposing sides of the tip end portion of each of needle electrodes 11 and 12. First protection portion 21 and second protection portion 22 are juxtaposed, with each of needle electrodes 11 and 12 lying therebetween, in the longitudinal direction of housing 40. First protection portion 21 and second protection portion 22 protrude outward from housing 40 and protrude outward relative to needle electrodes 11 and 12.

First protection portion 21 and second protection portion 22 are constituted of top plate 21*a* and support portion 21*b* and top plate 22*a* and support portion 22*b*, respectively. Top plates 21*a* and 22*a* are each in a strip shape, and two support portions 21*b*, 22*b* extend from opposing ends of respective top plates 21*a* and 22*a* toward housing 40. First protection portion 21*a* and second protection portion 22*b* form an arch shape, and an opening is formed between two support portions 21*b*, 22*b*. When the ion generation apparatus in the present embodiment is viewed in the longitudinal direction of housing 40, tip ends of needle electrodes 11 and 12 can visually be recognized through the opening provided between support portions 21*b*, 22*b*.

Eighth Embodiment

Figure 13:
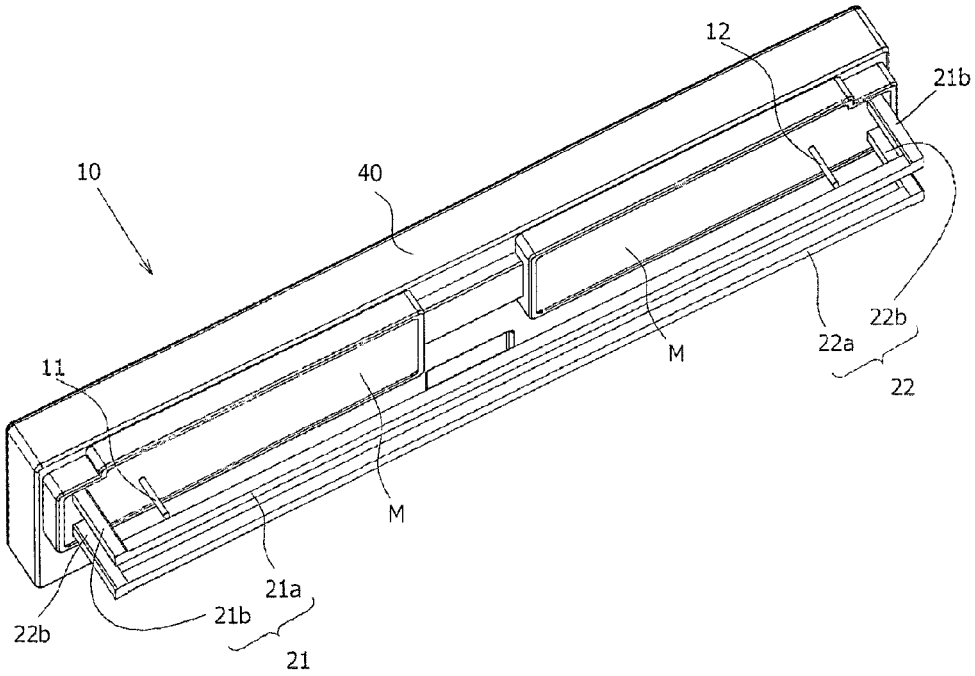
FIG. 13 is a perspective view of an ion generation apparatus according to an eighth embodiment of the present invention.

FIG. 13 is a perspective view of an ion generation apparatus according to an eighth embodiment of the present invention, which is compared with FIG. 3. This ion generation apparatus in FIG. 13 is different from the ion generation apparatus in FIG. 3 in a shape of electrode protection portion 20. Since features other than electrode protection portion 20 are the same as in the ion generation apparatus in the first embodiment, description will not be provided.

One electrode protection portion 20 is provided to correspond to a region where needle electrode 11 at the one end portion and needle electrode 12 at the other end portion in the longitudinal direction of housing 40 are provided. The electrode protection portion has first protection portion 21 and second protection portion 22 opposed to each other at a distance from each other on opposing sides of the tip end portion of each of needle electrodes 11 and 12. First protection portion 21 and second protection portion 22 are juxtaposed, with needle electrodes 11 and 12 lying therebetween, in the direction of the short side of housing 40. First protection portion 21 and second protection portion 22 protrude outward from housing 40 and protrude outward relative to needle electrodes 11 and 12. Electrode protection portion 20 in the present embodiment is constructed such that both of needle electrode 11 and needle electrode 12 lie between a pair of first protection portion 21 and second protection portion 22.

First protection portion 21 and second protection portion 22 are constituted of top plate 21*a* and support portion 21*b* and top plate 22*a* and support portion 22*b*, respectively. Top plates 21*a* and 22*a* are each in a strip shape, and two support portions 21*b*, 22*b* extend from opposing ends of respective top plates 21*a* and 22*a* toward housing 40. First protection portion 21*a* and second protection portion 22*b* form an arch shape, and an opening is formed between two support portions 21*b*, 22*b*. When the ion generation apparatus in the present embodiment is viewed in the direction of the short side of housing 40, tip ends of needle electrodes 11 and 12 can visually be recognized through the opening provided between support portions 21*b*, 22*b*.

Thus, the embodiments disclosed herein are illustrative and non-restrictive in every respect. The technical scope of the present invention is delimited by the terms of the claims and is intended to include any modifications within the scope and meaning equivalent to the terms of the claims.

REFERENCE SIGNS LIST

10 ion generation apparatus
11, 12 needle electrode
13, 14 induction electrode
20 electrode protection portion
21 first protection portion
22 second protection portion
31, 32 printed circuit board
40 housing
41 housing main body
42 lid body
43 substrate placement surface
44 opening portion
45 hole
46 housing wall surface
47 wall surface
50 air cleaner main body
52 cross flow fan (air blower)

The invention claimed is:

1. An ion generation apparatus, comprising:
a housing;
a substrate accommodated in said housing;
a needle electrode that generates ions through discharging, which is held by said substrate such that a tip end portion protrudes outside said housing;
an insulating sealing portion insulating and sealing said substrate in said housing; and
an electrode protection portion that protects said needle electrode outside said housing, the electrode protection portion being defined by a strip-shaped projection member having an arched shape,
said housing being provided with an opening portion through which a side of the tip end portion of said needle electrode is inserted and which is sealed with said insulating sealing portion, and
said electrode protection portion including a first protection portion and a second protection portion provided to protrude from said housing relative to the tip end portion of said needle electrode and opposed to each other at a distance from each other on opposing sides of said needle electrode.

2. The ion generation apparatus according to claim 1, wherein
a hole through which air toward said needle electrode passes is provided in at least one of said first protection portion and said second protection portion.

3. The ion generation apparatus according to claim 1, wherein
said insulating sealing portion includes an electrode sealing region sealing a portion of said needle electrode, and
said electrode sealing region is exposed to outside of said housing.

4. The ion generation apparatus according to claim 1, wherein
a root side of a shaft center portion of said electrode protection portion is sealed with said insulating sealing portion.

5. The ion generation apparatus according to claim 1, further comprising an induction electrode provided in said housing and defining electric field between the induction electrode and said needle electrode, wherein said induction electrode is sealed with said insulating sealing portion.

6. The ion generation apparatus according to claim 1, wherein said first protection portion and said second protection portion are separate from each other in a region not sealed with said insulating sealing portion.

7. The ion generation apparatus according to claim 1, wherein said needle electrode includes a positive ion generation electrode that generates positive ions and a negative ion generation electrode that generates negative ions, said insulating sealing portion includes a positive-side insulating sealing portion sealing a portion of a shaft center portion of said positive ion generation electrode and a negative-side insulating sealing portion sealing a portion of a shaft center portion of said negative ion generation electrode, and said positive-side insulating sealing portion and said negative-side insulating sealing portion are provided at a prescribed distance from each other.

8. Electric equipment, comprising:

the ion generation apparatus according to claim 1; and an air blower sending ions generated from said ion generation apparatus to outside.

* * * * *